US006382913B1

(12) United States Patent
Lee et al.

(10) Patent No.: US 6,382,913 B1
(45) Date of Patent: May 7, 2002

(54) METHOD AND APPARATUS FOR REDUCING TURBINE BLADE TIP REGION TEMPERATURES

(75) Inventors: Ching-Pang Lee; Chander Prakash, both of Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/783,279

(22) Filed: Feb. 9, 2001

(51) Int. Cl.[7] ..... F01D 5/18
(52) U.S. Cl. ..... 416/96 R; 416/97 R; 416/92
(58) Field of Search ..... 415/115; 416/96 R, 416/96 A, 97 R, 97 A, 92

(56) References Cited

U.S. PATENT DOCUMENTS 4,589,824 A 5/1986 Kozlin
5,261,789 A 11/1993 Butts et al.
6,059,530 A * 5/2000 Lee ..... 416/97 R
6,164,914 A 12/2000 Correia et al.
6,179,556 B1 1/2001 Bunker

* cited by examiner

*Primary Examiner*—F. Daniel Lopez
*Assistant Examiner*—James M McAleenan
(74) *Attorney, Agent, or Firm*—William Scott Andes; Armstrong Teasdale LLP

(57) ABSTRACT

A rotor blade for a gas turbine engine including a tip region that facilitates reducing operating temperatures of the rotor blade is described. The tip region includes a first tip wall and a second tip wall extending radially outward from a tip plate of an airfoil. The tip walls extend from adjacent a leading edge of the airfoil to connect at a trailing edge of the airfoil. A portion of the second tip wall is recessed to define a tip shelf that extends from the airfoil leading edge to the airfoil trailing edge.

18 Claims, 2 Drawing Sheets

METHOD AND APPARATUS FOR REDUCING TURBINE BLADE TIP REGION TEMPERATURES

BACKGROUND OF THE INVENTION

This application relates generally to gas turbine engine rotor blades and, more particularly, to methods and apparatus for reducing rotor blade tip temperatures.

Gas turbine engine rotor blades typically include airfoils having leading and trailing edges, a pressure side, and a suction side. The pressure and suction sides connect at the airfoil leading and trailing edges, and span radially between the airfoil root and the tip. To facilitate reducing combustion gas leakage between the airfoil tips and stationary stator components, the airfoils include a tip region that extends radially outward from the airfoil tip.

The airfoil tip regions include a first tip wall extending from the airfoil leading edge to the trailing edge, and a second tip wall also extending from the airfoil leading edge to connect with the first tip wall at the airfoil trailing edge. The tip region prevents damage to the airfoil if the rotor blade rubs against the stator components.

During operation, combustion gases impacting the rotating rotor blades transfer heat into the blade airfoils and tip regions. Over time, continued operation in higher temperatures may cause the airfoil tip regions to thermally fatigue. To facilitate reducing operating temperatures of the airfoil tip regions, at least some known rotor blades include slots within the tip walls to permit combustion gases at a lower temperature to flow through the tip regions.

To facilitate minimizing thermal fatigue to the rotor blade tips, at least some known rotor blades include a shelf adjacent the tip region to facilitate reducing operating temperatures of the tip regions. The shelf is defined to extend partially within the pressure side of the airfoil to disrupt combustion gas flow as the rotor blades rotate, thus enabling a film layer of cooling air to form against a portion of the pressure side of the airfoil.

BRIEF SUMMARY OF THE INVENTION

In an exemplary embodiment, a rotor blade for a gas turbine engine includes a tip region that facilitates reducing operating temperatures of the rotor blade, without sacrificing aerodynamic efficiency of the turbine engine. The tip region includes a first tip wall and a second tip wall that extend radially outward from an airfoil tip plate. The first tip wall extends from a leading edge of the airfoil to a trailing edge of the airfoil. The second tip wall also extends from the airfoil leading edge and connects with the first tip wall at the airfoil trailing edge to define an open-top tip cavity. At least a portion of the second tip wall is recessed to define a tip shelf that extends between the airfoil leading and trailing edges.

During operation, as the rotor blades rotate, combustion gases at a higher temperature near a pitch line of each rotor blade migrate to the airfoil tip region and towards the rotor blade trailing edge. Because the tip walls extend from the airfoil, a tight clearance is defined between the rotor blade and stationary structural components that facilitates reducing combustion gas leakage therethrough. If rubbing occurs between the stationary structural components and the rotor blades, the tip walls contact the stationary components and the airfoil remains intact. As the rotor blade rotates, combustion gases at lower temperatures near the leading edge of the tip region flow past the airfoil tip shelf. The tip shelf disrupts the combustion gas radial flow causing the combustion gases to separate from the airfoil sidewall, thus facilitating a decrease in heat transfer thereof. As a result, the tip shelf facilitates reducing operating temperatures of the rotor blade within the tip region, but without consuming additional cooling air, thus improving turbine efficiency.

DETAILED DESCRIPTION OF THE INVENTION

Figure 1:
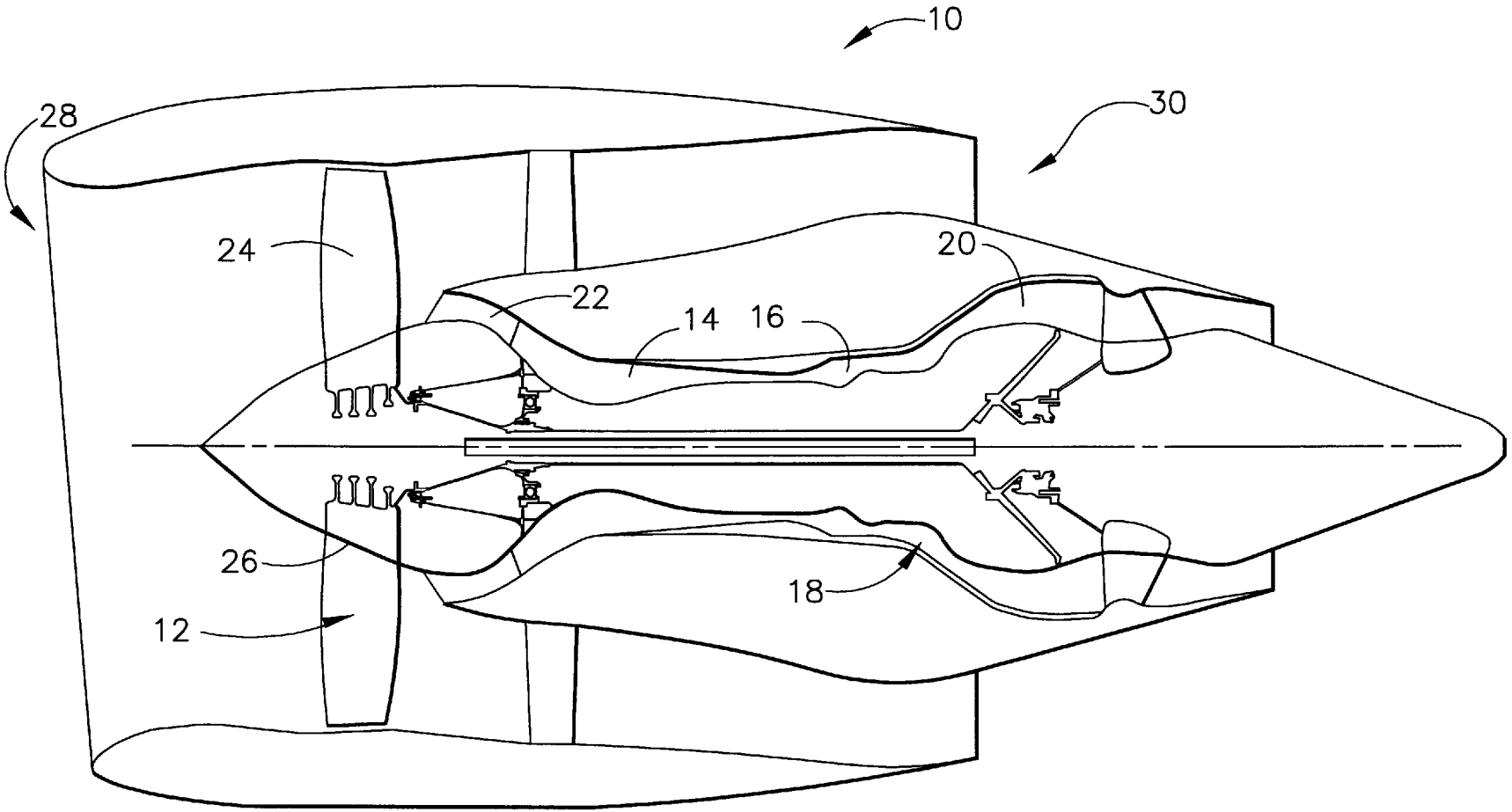
FIG. 1 is a schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30.

In operation, air flows through fan assembly 12 and compressed air is supplied to high pressure compressor 14. The highly compressed air is delivered to combustor 16. Airflow (not shown in FIG. 1) from combustor 16 drives turbines 18 and 20, and turbine 20 drives fan assembly 12.

Figure 2:
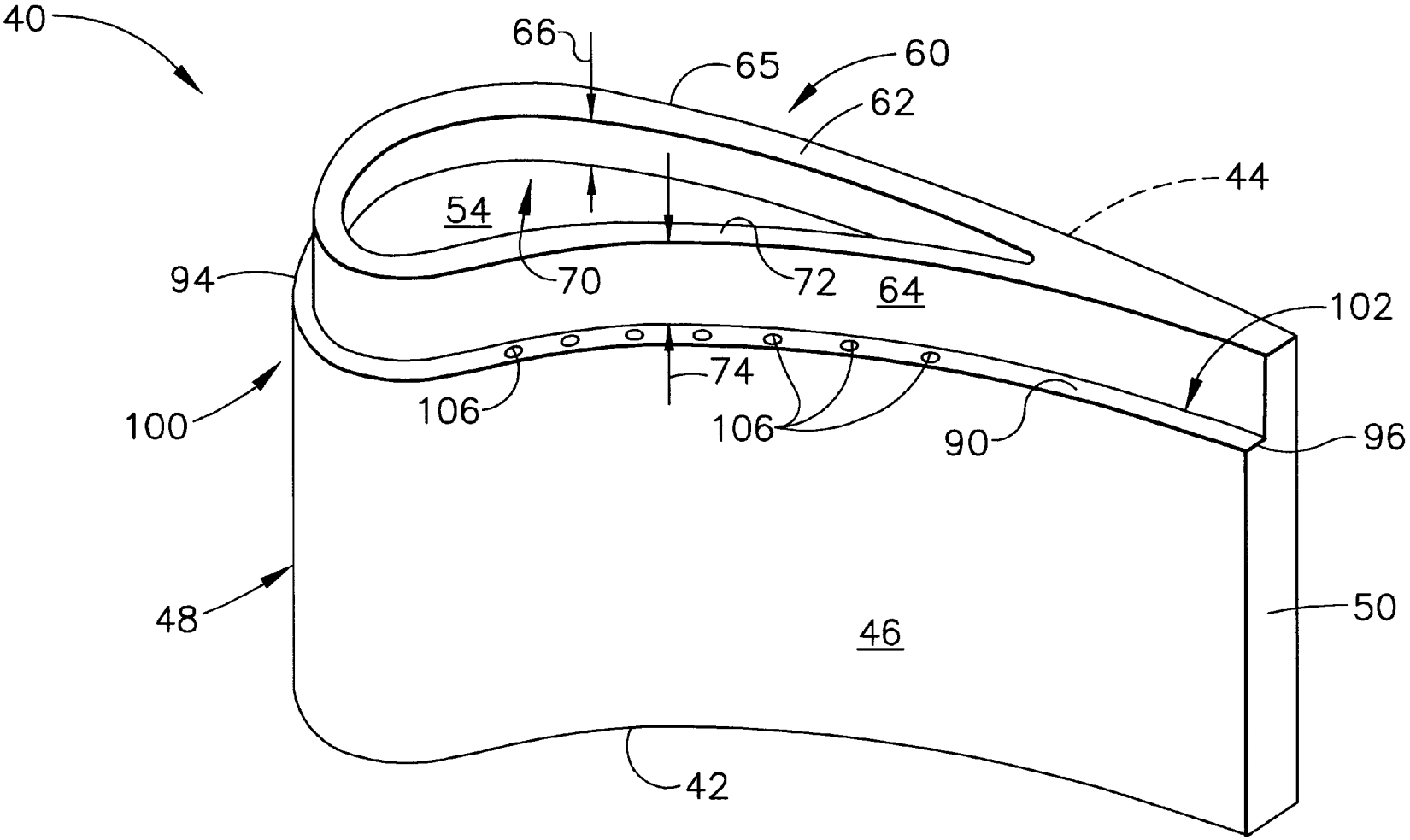
FIG. 2 is a partial perspective view of a rotor blade that may be used with the gas turbine engine shown in FIG. 1.

FIG. 2 is a partial perspective view of a rotor blade 40 that may be used with a gas turbine engine, such as gas turbine engine 10 (shown in FIG. 1). In one embodiment, a plurality of rotor blades 40 form a high pressure turbine rotor blade stage (not shown) of gas turbine engine 10. Each rotor blade 40 includes a hollow airfoil 42 and an integral dovetail (not shown) used for mounting airfoil 42 to a rotor disk (not shown) in a known manner.

Airfoil 42 includes a first sidewall 44 and a second sidewall 46. First sidewall 44 is convex and defines a suction side of airfoil 42, and second sidewall 46 is concave and defines a pressure side of airfoil 42. Sidewalls 44 and 46 are joined at a leading edge 48 and at an axially-spaced trailing edge 50 of airfoil 42 that is downstream from leading edge 48.

First and second sidewalls 44 and 46, respectively, extend longitudinally or radially outward to span from a blade root (not shown) positioned adjacent the dovetail to a tip plate 54 which defines a radially outer boundary of an internal cooling chamber (not shown). The cooling chamber is defined within airfoil 42 between sidewalls 44 and 46. Internal cooling of airfoils 42 is known in the art. In one embodiment, the cooling chamber includes a serpentine passage cooled with compressor bleed air. In another embodiment, sidewalls 44 and 46 include a plurality of film cooling openings (not shown), extending therethrough to facilitate additional cooling of the cooling chamber. In yet another embodiment, airfoil 42 includes a plurality of trailing edge openings (not shown) used to discharge cooling air from the cooling chamber.

A tip region 60 of airfoil 42 is sometimes known as a squealer tip, and includes a first tip wall 62 and a second tip wall 64 formed integrally with airfoil 42. First tip wall 62 extends from adjacent airfoil leading edge 48 along airfoil first sidewall 44 to airfoil trailing edge 50. More specifically, first tip wall 62 extends from tip plate 54 to an outer edge 65 for a height 66. First tip wall height 66 is substantially constant along first tip wall 62.

Second tip wall 64 extends from adjacent airfoil leading edge 48 along second sidewall 46 to connect with first tip wall 62 at airfoil trailing edge 50. More specifically, second tip wall 64 is laterally spaced from first tip wall 62 such that an open-top tip cavity 70 is defined with tip walls 62 and 64, and tip plate 54. Second tip wall 64 also extends radially outward from tip plate 54 to an outer edge 72 for a height 74. In the exemplary embodiment, second tip wall height 74 is equal first tip wall height 66. Alternatively, second tip wall height 74 is not equal first tip wall height 66.

Second tip wall 64 is recessed at least in part from airfoil second sidewall 46. More specifically, second tip wall 64 is recessed from airfoil second sidewall 46 toward first tip wall 62 to define a radially outwardly facing tip shelf 90 which extends generally between airfoil leading and trailing edges 48 and 50. More specifically, tip shelf 90 includes a front edge 94 and an aft edge 96. Airfoil leading edge 48 includes a stagnation point 100, and tip shelf front edge 94 is extended from airfoil second sidewall 46 through leading edge stagnation point 100 and tapers flush with first sidewall 44. Tip shelf 90 extends aft from airfoil leading edge 48 to airfoil trailing edge 50, such that tip shelf aft edge 96 is substantially co-planar with airfoil trailing edge 50.

Recessed second tip wall 64 and tip shelf 90 define a generally L-shaped trough 102 therebetween. In the exemplary embodiment, tip plate 54 is generally imperforate and only includes a plurality of openings 106 extending through tip plate 54 at tip shelf 90. Openings 106 are spaced axially along tip shelf 90 between airfoil leading and trailing edges 48 and 50, and are in flow communication between trough 102 and the internal airfoil cooling chamber. In one embodiment, tip region 60 and airfoil 42 are coated with a thermal barrier coating.

During operation, squealer tip walls 62 and 64 are positioned in close proximity with a conventional stationary stator shroud (not shown), and define a tight clearance (not shown) therebetween that facilitates reducing combustion gas leakage therethrough. Tip walls 62 and 64 extend radially outward from airfoil 42. Accordingly, if rubbing occurs between rotor blades 40 and the stator shroud, only tip walls 62 and 64 contact the shroud and airfoil 42 remains intact.

Because combustion gases assume a parabolic profile flowing through a turbine flowpath at blade tip region leading edge 48, combustion gases near turbine blade tip region 60 are at a lower temperature than gases near a blade pitch line (not shown) of turbine blades 40. As combustion gases flow from blade tip region leading edge 48 towards blade trailing edge 50, hotter gases near the pitch line migrate radially towards a tip region 60 of rotor blades 40 due to blade rotation. Therefore, at tip region 60, the gases near leading edge 48 are cooler than gases at trailing edge 50. As combustion gases flow radially past airfoil tip shelf 90, trough 102 provides a discontinuity in airfoil pressure side 46 which causes the hotter combustion gases to separate from airfoil second sidewall 46, thus facilitating a decrease in heat transfer thereof Additionally, trough 102 provides a region for cooling air to accumulate and form a film against sidewall 46. Tip shelf openings 106 discharge cooling air from the airfoil internal cooling chamber to form a film cooling layer on tip region 60. As a result, tip shelf 90 facilitates improving cooling effectiveness of the film to lower operating temperatures of sidewall 46.

The above-described rotor blade is cost-effective and highly reliable. The rotor blade includes a tip shelf extending from the airfoil leading edge to the airfoil trailing edge. The tip shelf disrupts combustion gases flowing past the airfoil to facilitate the formation of a cooling layer against the tip shelf As a result, cooler operating temperatures within the rotor blade facilitate extending a useful life of the rotor blades in a cost-effective and reliable manner.

While the invention has been described in terms of various specific embodiments, those skilled in the art will recognize that the invention can be practiced with modification within the spirit and scope of the claims.

What is claimed is:

1. A method for fabricating a rotor blade for a gas turbine engine to facilitate reducing operating temperatures of a tip portion of the rotor blade, the rotor blade including a leading edge, a trailing edge, a first sidewall, and a second sidewall, the first and second sidewalls connected axially at the leading and trailing edges, and extending radially between a rotor blade root to a rotor blade tip plate, said method comprising the steps of:

forming a first tip wall extending from the rotor blade tip plate along the first sidewall, such that at least a portion of the first tip wall is at least partially recessed with respect to the rotor blade first sidewall and defines a tip shelf that extends from the airfoil leading edge towards the airfoil trailing edge; and forming a second tip wall extending from the rotor blade tip plate along the second sidewall such that the second tip wall connects with the first tip wall at the rotor blade trailing edge.

2. A method in accordance with claim 1 further wherein said step of forming a first tip wall further comprises the step of forming a first tip wall such that the tip shelf extends from the airfoil leading edge to the airfoil trailing edge.

3. A method in accordance with claim 1 wherein said step of forming a first tip wall further comprises the step of forming the first tip wall to extend from a concave airfoil sidewall.

4. A method in accordance with claim 1 wherein said step of forming a first tip wall further comprises the step of forming a plurality of film cooling openings extending into the tip shelf.

5. A method in accordance with claim 4 wherein said step of forming a plurality of film cooling openings further comprises the step spacing the film cooling openings along the tip shelf between the airfoil leading edge and the airfoil trailing edge to facilitate reducing heat load induced into the first and second tip walls.

6. An airfoil for a gas turbine engine, said airfoil comprising:

a leading edge;

a trailing edge, a tip plate;

a first sidewall extending in radial span between an airfoil root and said tip plate;

a second sidewall connected to said first sidewall at said leading edge and said trailing edge, said second sidewall extending in radial span between the airfoil root and said tip plate;

a first tip wall extending radially outward from said tip plate along said first sidewall; and a second tip wall extending radially outward from said tip plate along said second sidewall, said first tip wall connected to said second tip wall at said trailing edge, said first tip wall at least partially recessed with respect to said rotor blade first sidewall to define a tip shelf extending from said airfoil leading edge towards said airfoil trailing edge.

7. An airfoil in accordance with claim 6 wherein said first tip wall and said second tip wall are substantially equal in height.

8. An airfoil in accordance with claim 6 wherein said first tip wall extends a first distance from said tip plate, said second tip wall extends a second distance from said tip plate.

9. An airfoil in accordance with claim 6 wherein said tip shelf extends to said airfoil trailing edge.

10. An airfoil in accordance with claim 6 wherein said tip shelf comprises a plurality of film cooling openings.

11. An airfoil in accordance with claim 6 wherein said tip shelf configured to facilitate reducing heat load induced to said first and second tip walls.

12. An airfoil in accordance with claim 6 wherein said rotor blade airfoil first sidewall is substantially concave, said rotor blade airfoil second sidewall is substantially convex.

13. A gas turbine engine comprising a plurality of rotor blades, each said rotor blade comprising an airfoil comprising a leading edge, a trailing edge, a first sidewall, a second sidewall, a first tip wall, and a second tip wall, said airfoil first and second sidewalls connected axially at said leading and trailing edges, said first and second sidewalls extending radially from a blade root to said tip plate, said first tip wall extending radially outward from said tip plate along said first sidewall, said second tip wall extending radially outward from said tip plate along said second sidewall, said first tip wall at least partially recessed with respect to said rotor blade first sidewall to define a tip shelf extending from said airfoil leading edge towards said airfoil trailing edge.

14. A gas turbine engine in accordance with claim 13 wherein said rotor blade airfoil first sidewall is substantially concave, said rotor blade airfoil second sidewall is substantially convex.

15. A gas turbine engine in accordance with claim 14 wherein said rotor blade airfoil tip shelf extends to said airfoil trailing edge.

16. A gas turbine engine in accordance with claim 15 wherein said rotor blade airfoil first tip wall and said airfoil second tip wall are substantially equal in height.

17. A gas turbine engine in accordance with claim 15 wherein said rotor blade airfoil first tip wall extends a first distance from said tip plate, said rotor blade airfoil second tip wall extends a second distance from said tip plate.

18. A gas turbine engine in accordance with claim 15 wherein said rotor blade airfoil tip shelf comprises a plurality of film cooling openings.

* * * * *